United States Patent [19]

Bishow

[11] 4,193,592

[45] Mar. 18, 1980

[54] ROCKING, TURNING TOY

[76] Inventor: Raymond L. Bishow, 61 N. Laurel St., Ventura, Calif. 93003

[21] Appl. No.: 944,990

[22] Filed: Sep. 22, 1978

[51] Int. Cl.[2] ..... A63B 23/00; B62B 11/00

[52] U.S. Cl. ..... 272/114; 272/144; 272/33 R

[58] Field of Search ..... 272/146, 114, 46, 49, 272/48, 144, 33 R, 33 A; 280/87.01, 87.02, 205

[56] References Cited

U.S. PATENT DOCUMENTS

| | | | |
|---|---|---|---|
| 2,351,293 | 6/1944 | Saunders | 272/46 |
| 3,522,953 | 8/1970 | Gold | 272/114 |
| 3,604,722 | 9/1971 | Boley | 280/87.01 |
| 3,649,007 | 3/1972 | Thomas | 272/146 |
| 3,749,399 | 7/1973 | Fedor | 272/33 A |

FOREIGN PATENT DOCUMENTS

| | | | |
|---|---|---|---|
| 2239545 | 2/1974 | Fed. Rep. of Germany | 272/146 |
| 528273 | 11/1972 | Switzerland | 272/114 |

*Primary Examiner*—Richard J. Johnson
*Attorney, Agent, or Firm*—Jack C. Munro

[57] ABSTRACT

A rocking rotational toy which comprises a base member upon which the user is to sit, stand or kneel. From the lower surface of the base member extends a shaft. The shaft is to be rotationally mounted within the lower member. A caster assembly is located between the top surface of the lower member and the lower surface of the base permitting rotational movement therebetween. Fixedly mounted upon the under surface of the bottom member is an enlarged protuberance which has a flat bottom. During use of the device, the user rotates upon the bottom member and also rocks upon the enlarged protuberance.

10 Claims, 6 Drawing Figures

Fig. 1
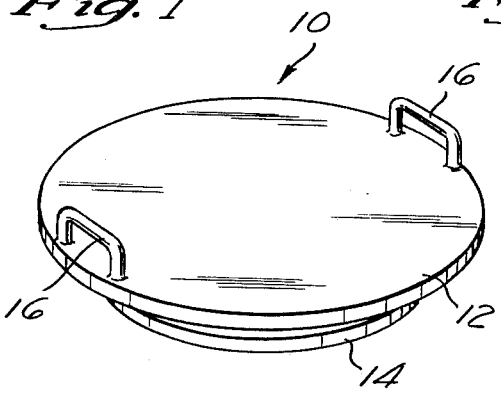
Fig. 2
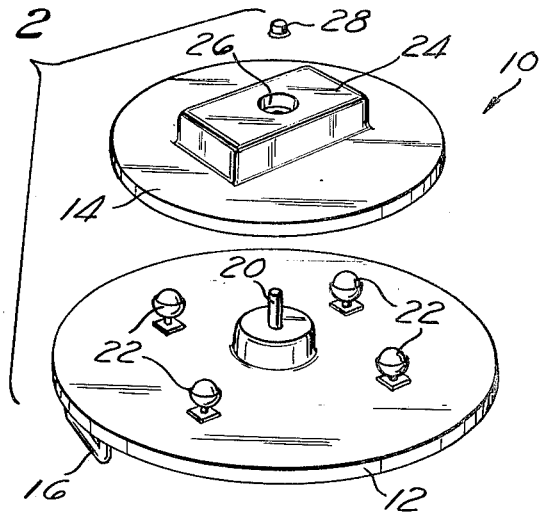
Fig. 3
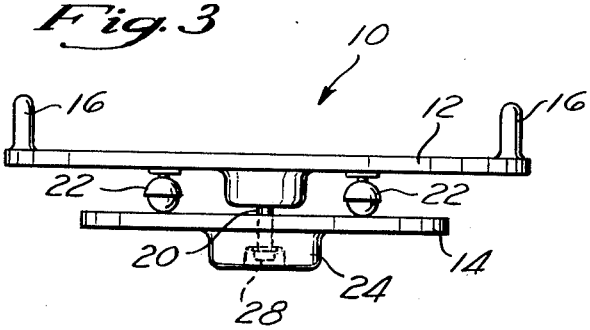
Fig. 5
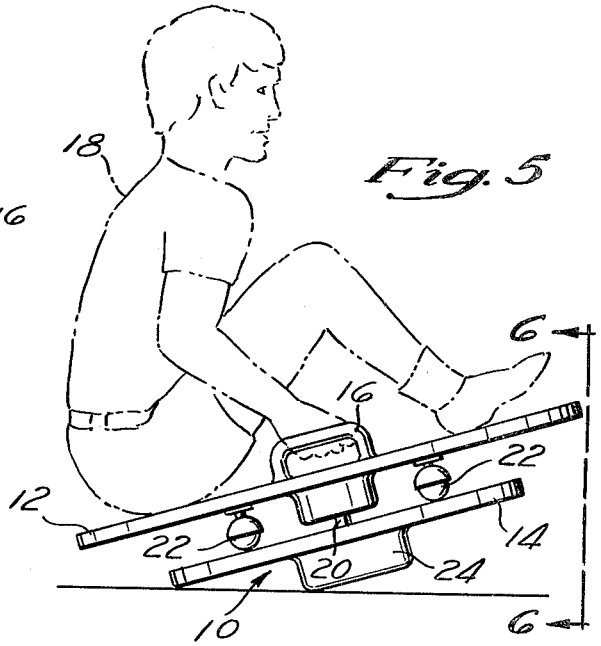
Fig. 4
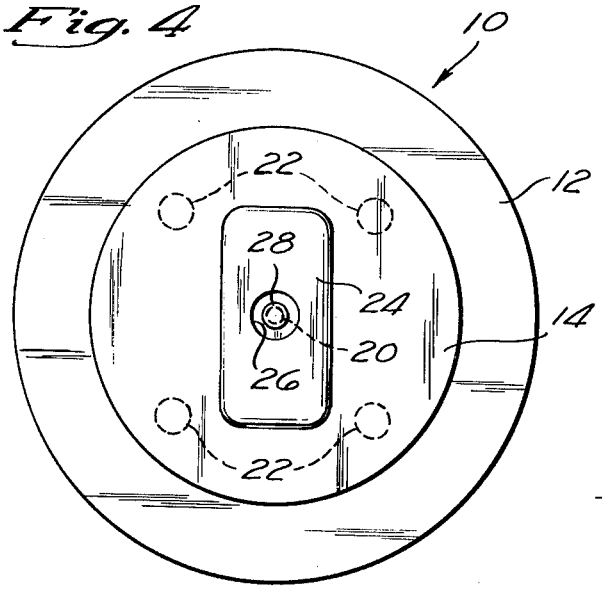
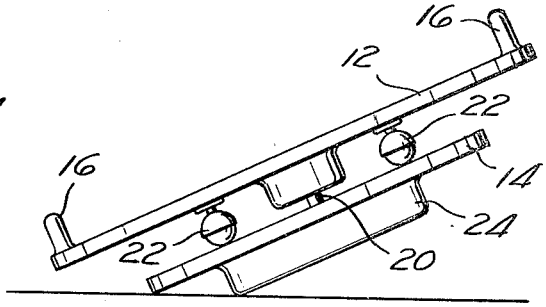
Fig. 6

ROCKING, TURNING TOY

BACKGROUND OF THE INVENTION

The field of this invention relates to toys and more specifically to a toy which is adapted to be used in a prestablished position upon a supportive surface.

There is to have been known toys which when used by children rock in an oscillatory motion. There has also been known toys which when used rotate. Previous to this invention there has not been known a toy which achieved both objectives simultaneously and is also at the control and/or direction of the user.

SUMMARY OF THE INVENTION

The toy of this invention comprises a planer member upon which the user can sit, kneel or stand on the upper surface thereof. The planer member will normally be constructed of a circular configuration. Extending from the lower surface thereof and being fixed in respect thereto is a shaft. The shaft is centrally attached to the planer base. Also attached to the planer base and evenly spaced apart and located in a concentric arrangement in respect to the shaft are a plurality of caster assemblies. The bottom member, which has a smooth upper surface, is connected to the shaft with rotational movement being permitted therebetween. The caster assemblies ride upon the upper surface of the bottom member. Normally the bottom member will also be of a circular configuration. The bottom member will also have a diameter somewhat less than the diameter of the planer base. An enlarged protuberance is fixedly attached to the lower surface of the bottom member. The enlarged protuberance has a planer under surface. The enlarged protuberance is centrally located upon the bottom member but is not necessarily circular but could be of a square or rectangular configuration. A preferable size relationship for the planer undersurface of the enlarged protuberance is two inches by four inches with the diameter of the bottom member being approximately sixteen inches. The preferable size for the planer base would be approximately twenty-four inches in diameter.

The primary objective of this invention is to construct a new and interesting toy which uses two different motions simultaneously and in combination so that the user when rotating can impart different rocking inertial movement to the device which then causes the user to experience a unique overall movement.

BRIEF DESCRIPTION OF THE DRAWING

FIG. 1 is a top, plan isometric view of the toy of this invention;

FIG. 2 is an exploded bottom isometric view of the toy of this invention;

FIG. 3 is a side view of the toy of this invention;

FIG. 4 is a bottom view of the toy of this invention;

FIG. 5 is a side view similar to FIG. 3 but showing the toy being used; and FIG. 6 is a right side elevational view taken along line 6—6 of FIG. 5.

DETAILED DESCRIPTION OF THE SHOWN EMBODIMENT

Referring particularly to the drawing there is shown the toy 10 of this invention which is composed primarily of a planer base 12 and a bottom member 14. The planer base 12 and the bottom member 14 are both constructed of thin sheet material and will normally be constructed of a plastic or wood. Both the planer base 12 and the bottom member 14 are shown to be circular in configuration.

Attached to the upper surface of the planer base 12 are a pair of handles 16. The handles 16 are to facilitate grasping by the user 18.

Fixedly secured to and extending from the lower surface of the planar base 12 is a shaft 20. The shaft 20 is mounted at the center of the circular planer base 12. Concentrically disposed about the shaft 12 and fixedly secured to the lower surface of the planer base 12 are a plurality of evenly spaced apart caster assemblies 22.

Each of the caster assemblies 22 are to be in low frictional contact with the smooth top surface of the bottom member 14. It is to be understood that the top surface of the bottom member 14, although shown planer, could possibly assume some other smooth contour as desired.

The shaft 20 extends through an opening centrally located within the bottom member 14. The shaft 20 then extends into an enlarged protuberance 24 which is fixedly mounted upon the under surface of the bottom member 14. The enlarged protuberance 24 is shown to have a planer or flat bottom surface which is important within this invention. The enlarged protuberance 24 is shown to be substantially rectangular but it is to be understood that it could be any other desirable configuration such as circular, square or any other polygonal configuration. The shaft 20 cooperates within a recess 26 formed within the enlarged protuberance 24. A nut assembly 28 connects with the shaft 20 to interconnect the members 12 and 14 into a single unit.

In the operation of the device 10 of this invention, the user 18 only needs to sit, stand, kneel or otherwise occupy the top upper surface of the planer base 12 and grab onto the handle 16. The user 18 then begins a rocking motion and a body rotational motion which in turn causes the planer base 12 to rotate with respect to the bottom member 14 by means of caster assemblies 22. Continued rotational movement by the user 18 and continued rocking motion by the user 18 causes moments of increased momentum which in turn creates even more rotational movement. As a result the user 18 can achieve a high degree of rotational movement by combining not only the rotational momentum but also the rocking momentum.

During the use of the toy 10 of this invention, the user is prevented from tipping over by means of the peripheral edge of the bottom member 14. As can be seen within FIGS. 5 and 6 of the drawings, with the edge of the enlarged protuberance 24 in contact with the supportive surface, the peripheral edge of the bottom member 14 is also in contact with the supportive surface which leaves the peripheral edge of the planer base 12 spaced from the supportive surface.

What is claimed is:

1. A toy to be located and operated on a supportive surface comprising:

a planar base upon which the user is to be located on the upper surface thereof, a shaft connected to said base and extending from the lower surface thereof;

a bottom member having a top surface and a bottom surface, said bottom member to be located adjacent said lower surface of said planar base but spaced therefrom, said shaft located within said bottom member permitting rotational movement between said planar base and said bottom member, said top surface being of an area less than said lower surface of said planar base;

low frictional rolling means located between said lower surface of said planar base and said upper surface of said bottom member, said planar base being rotatable upon said bottom member by said low frictional rotational rolling means; and an enlarged protuberance attached to said bottom surface, said enlarged protuberance being spaced from the periphery of said bottom member, said enlarged protuberance to be in continuous contact with and rockingly move upon the supportive surface with the maximum tipping rocking movement being defined when the peripheral edge of said bottom member contacts the supportive surface.

2. The toy as defined in claim 1 wherein:

said shaft being substantially centrally located in respect to said planer base, said shaft being also centrally located in respect to said bottom member.

3. The toy as defined in claim 2 wherein:

said planar base being circular, said bottom surface being circular.

4. The toy as defined in claim 3 wherein:

said enlarged protuberance being substantially centrally located upon said bottom surface of said bottom member.

5. The toy as defined in claim 4 wherein:

said enlarged protuberance having a flat bottom surface, said toy can be located in an at rest position with said flat bottom surface being flush with the supportive surface and said peripheral edge being spaced from said supportive surface.

6. The toy as defined in claim 1 wherein:

said enlarged protuberance having a flat bottom surface, said toy can be located in an at rest position with said flat bottom surface being flush with the supportive surface and said peripheral edge being spaced from said supportive surface.

7. The toy as defined in claim 5 wherein:

said low frictional rolling means comprising a plurality of spaced apart caster assemblies.

8. The toy as defined in claim 7 wherein:

said caster assemblies being evenly spaced apart and located in a concentric manner in respect to said shaft.

9. The toy as defined in claim 1 wherein:

said low frictional rolling means comprising a plurality of spaced apart caster assemblies.

10. The toy as defined in claim 9 wherein:

said caster assemblies being evenly spaced apart and located in a concentric manner in respect to said shaft.

* * * * *